United States Patent [19]

Meschi

[11] Patent Number: 4,458,814

[45] Date of Patent: Jul. 10, 1984

[54] PACKING ASSEMBLY FOR SHEET MATERIAL

[76] Inventor: Luciano Meschi, Corso Amedeo, 73, 57100 Livorno, Italy

[21] Appl. No.: 541,496

[22] Filed: Oct. 13, 1983

Related U.S. Application Data

[63] Continuation of Ser. No. 276,015, Jun. 22, 1981, abandoned.

[30] Foreign Application Priority Data

Jun. 23, 1980 [IT] Italy ..... 22095/80[U]

[51] Int. Cl.[3] ..... B65D 85/62; B42D 19/00

[52] U.S. Cl. ..... 206/494; 281/2; 281/5; 206/499; 206/820; 206/813

[58] Field of Search ..... 206/494, 449, 499, 813, 206/460, 820; 229/175; 281/2, 5

[56] References Cited

U.S. PATENT DOCUMENTS

| | | | |
|---|---|---|---|
| 1,385,569 | 7/1921 | Mayer et al. | 281/5 |
| 2,446,400 | 8/1948 | Woolley | 242/67.2 |
| 3,083,009 | 3/1963 | Barr et al. | 281/5 |
| 3,285,405 | 11/1966 | Wanderer | 206/499 |
| 3,587,845 | 6/1971 | Wing | 206/554 |
| 3,631,972 | 1/1972 | Gendron | 206/494 X |
| 4,201,029 | 5/1980 | Lerner et al. | 206/494 X |
| 4,316,563 | 2/1982 | Turner et al. | 229/17 S X |

*Primary Examiner*—William T. Dixson, Jr.
*Assistant Examiner*—Brenda D. Ehrhardt
*Attorney, Agent, or Firm*—McAulay, Fields, Fisher, Goldstein & Nissen

[57] ABSTRACT

A packing assembly for form or sheet packages intended for data processing centers, comprising a box-like container having a front wing panel for the picking up of the last form or sheet of the package and a form package, wherein at least the bottom or last form is sideways positioned with respect to the lie plane of forms or sheets within the package.

10 Claims, 3 Drawing Figures

PACKING ASSEMBLY FOR SHEET MATERIAL

This application is a continuation of application Ser. No. 276,015, filed June, 22, 1981, now abandoned.

The present invention relates to a packing assembly for packages of sheet material of forms utilizable to feed printing machines within data processing centers.

It is known that within data processing centers the fast printing machines are fed with sheets or forms shaped as a continuous accordion-like strip, wherein the forms or sheets are superim-posed and united between themselves along opposed edges.

With the increased operative speed of printing machines the form package exhaustion occurs in very short times, so that the times required to settle a new form package in the place of the already exhausted one have acquired enormous importance.

A relevant obstacle to the automatic or partially automatic splicing of the last form, namely the bottom form of a package (for instance that feeding-in the printing machine), with the first form of another package, originates from the difficulty experienced in having access and picking up the last form from the bottom of the package.

The main purpose of the present invention is that of providing a packing assembly for sheet or form packages particularly for fast printing machines, wherein it will be possible to take on one side, the sheets or forms from the uppermost for the feeding to the printing machine and, on the other side, picking up the last form of the package for the splicing to the successive package.

This purpose is attained by means of a packing assembly for sheet or form packages, the sheets being united as a continuous accordion-like folded strip, characterized by the fact that the group of bottom forms is placed sideways and perpendicularly to the form or sheet package lie plane and the substantially parallelepipedon container wherein the package is inserted with said lie plane parallel to the bottom, includes an upper cover, that may be opened or torn and a front wing panel that may be opened in correspondence with the package last form, matching the more external form of said sideways placed group.

The features and advantages of the present invention will appear more clearly from the following detailed description, made in connection with attached drawings, wherein.

Figure 1:
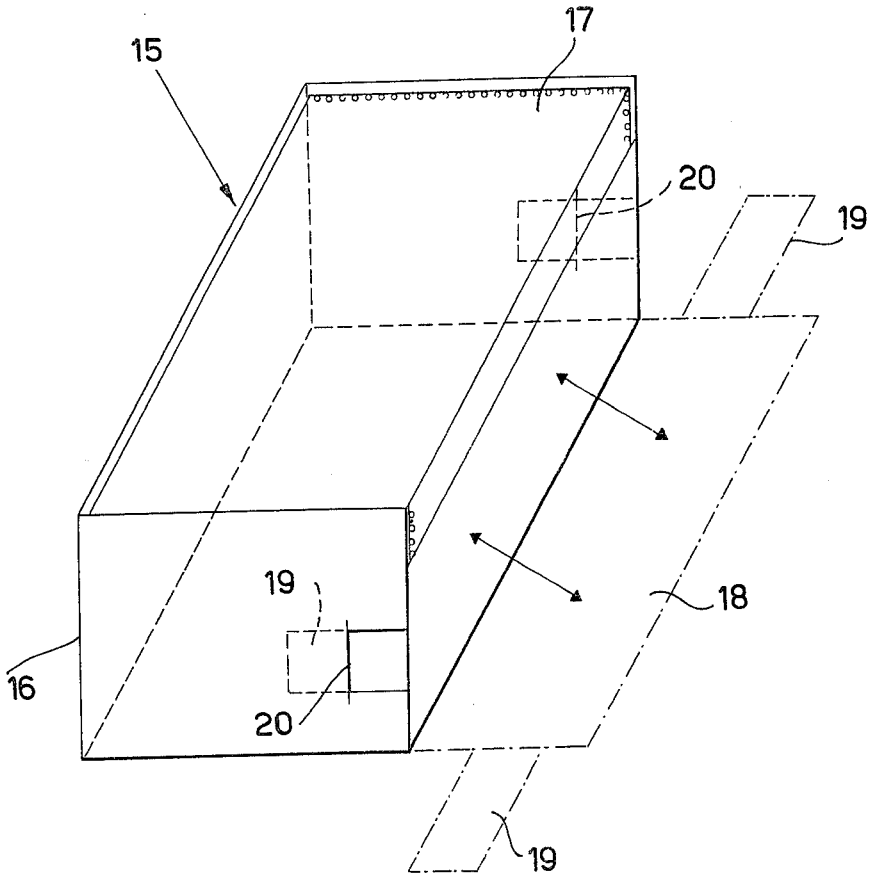
FIG. 1 is a schematic perspective view of the container for the packing assembly in accordance with the invention.
Figure 2:
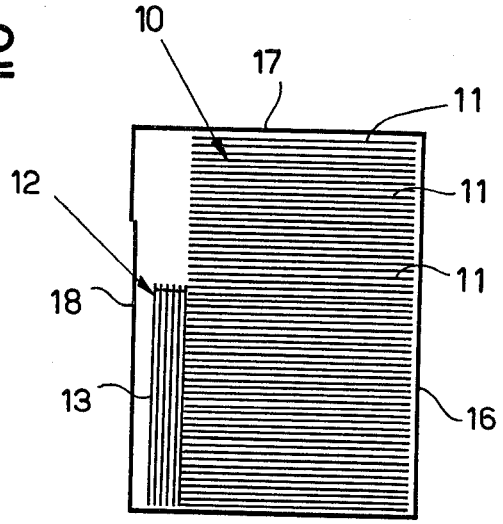
FIGS. 2 and 3 show the form packing assembly in its resting condition and in that of utilization and for example of splicing.
Figure 3:
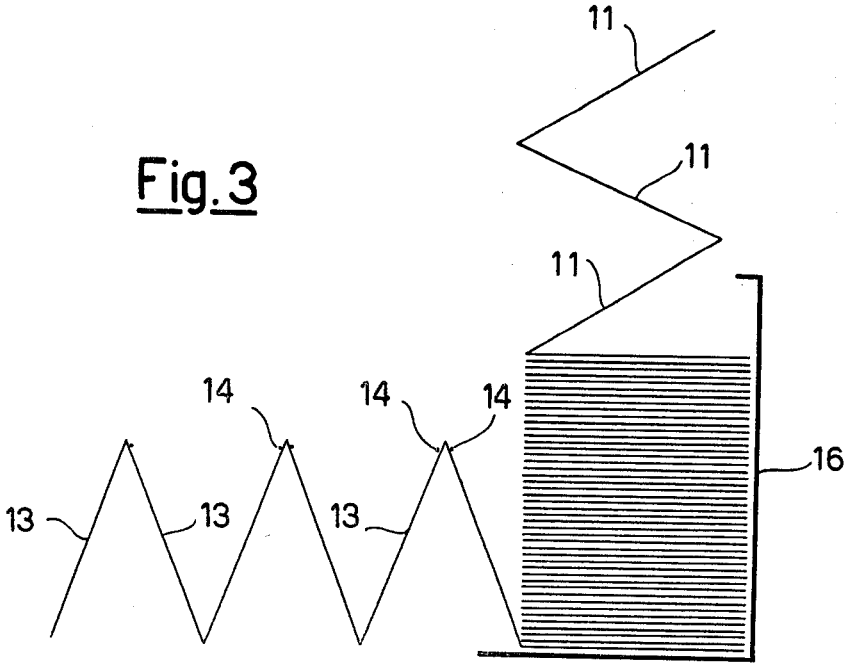

Referring to FIGS. 1 to 3, the reference numeral 10 (see FIG. 2) indicates the sheet or form package, shaped as an accordion-like folded continuous strip, so that the sheets or forms 11 are superimposed with a common lie plane, while a form group, indicated generally with the number 12, is placed sideways and perpendicularly in respect to the said lie plane, whereby the last form or sheet (indicated with 13) forming the package of group 12 will be the more external of the group 12.

To keep the group 12 forms into the desired position, they may be retained with reversible glue spots 14 in correspondence with the upper edges.

The container 15 is parallelepipedon shaped and consists in a box 16, equipped with an upper cover 17 that may be opened or torn (for example by means of prepunched tearing lines) and with an openable front wing panel 18 assembled to the box 16 by means of a tongue 19 adapted to fit into slits 20 provided in box 16 sides.

As it will be clearly seen from FIGS. 2 and 3, at the moment of utilization the cover 17 is opened or removed, so that form or sheets 11 will be extracted from the package 10 beginning from the upper form, and thereafter, to perform splicing to another form package, the wing panel 18 will be opened and the last sheet or form 13 picked up for splicing.

From the previous description it appears evident that with a packing assembly in accordance with the invention, handling of form packages will be made faster and easier thus fulfilling the requirements of modern data processing center.

The invention has been described in connection with a preferred embodiment it being understood that conceptually equivalent changes and modifications are possible and foreseable without falling out of the limits of the invention.

For example, the number of forms or sheets forming the group 12 depends on the size characteristics of the form, as well as on the nature of the material by which the forms are constituted; such a number shall thus vary between at least one form and a suitable figure.

The container 15 too can be of a suitable material, such as paper board, plastic material etc., according to the use requirements.

I claim:

1. A packing assembly for packages of sheet material or forms joined in an accordian-like fashion folded with continuous strips in overlapping relationship to produce a box-like container and a form package, wherein the bottom group of forms of the package within the container is placed sideways and perpendicularly to the lie of the plane of the sheet material or forms in the package, and the sideways group of sheets or forms are united amongst themselves with a glue applied along the upper edges of the forms.

2. A packing assembly for form packages of sheet material of forms utilizable to feed printing machines of the type used in data processing centers, comprising:

a container in the form of a parallelepipedon having an openable upper cover;

said sheet material of forms comprising a plurality of joined strips and forming two groups of strips joined and folded in an accordian-like fashion folded with continuous strips to lie in parallel planes in said container in a complete overlapping relationship;

one of said group of strips lying in parallel planes parallel to said upper cover, and the other of said group of strips lying in parallel planes perpendicular to said cover and the parallel planes of said first group, the last strip of said first group being connected with the first strip of said second group; and glue spots on at least one of each pair of adjacent accordian-like joined strips for keeping thereof in overlapping relationship in each of said groups; and said strips being extracted from said container after opening said upper cover.

3. The packing assembly as claimed in claim 2, wherein said glue spots are in correspondence with the upper edges of said strips.

4. The packing assembly as claimed in claim 2, wherein said container includes an openable front cover to permit splicing to another form package, said front cover being in a plane parallel to said second group of strips.

5. A packing assembly for form packages of sheet material of forms utilizable to feed printing machines of the type used in data processing centers, comprising:

a container in the form of a parallelepipedon having an openable upper cover;

said sheet material of forms comprising a plurality of joined strips and forming two groups of strips joined and folded in an accordian-like fashion folded with continuous strips to lie in parallel planes in said container in a complete overlapping relationship;

one of said group of strips lying in parallel planes parallel to said upper cover, and the other of said group of strips lying in parallel planes perpendicular to said cover and the parallel planes of said first group, the last strip of said first group being connected with the first strip of said second group; and means for maintaining the adjacent accordian-like joined strips in overlapping relationship in each of said groups; and said strips being extracted from said container after opening said upper cover.

6. The packing assembly as claimed in claim 5, wherein said maintaining means includes glue spots in correspondence with the upper edges of said strips.

7. The packing assembly as claimed in claim 5, wherein said container includes an openable front cover to permit splicing to another form package, said front cover being in a plane parallel to said second group of strips.

8. The packing assembly as claimed in claim 7, wherein said maintaining means includes glue spots on at least one of each pair of adjacent accordian-like joined strips for keeping thereof in overlapping relationship in each of said groups.

9. The packing assembly as claimed in claim 5, including:

an openable front cover to permit splicing to another form package, said front cover having a tongue; and slits provided in sides of said container for receiving said tongues for holding said openable front cover in its closed condition, said front cover being openable to permit the last sheet of the sheet material to be picked up for splicing to a sheet of another form package.

10. The packing assembly as claimed in claim 9, including glue spots in correspondence with the upper edges of said strips for keeping each pair of adjacent accordian-like joined strips in overlapping relationship.

* * * * *